United States Patent [19]

Urakami et al.

[11] 3,958,652

[45] May 25, 1976

[54] APPARATUS MOVABLY ADHERING TO A WALL AND ADAPTED TO CARRY A CLEANING APPARATUS

[75] Inventors: Fukashi Urakami, Kumamoto; Hiroyuki Yamashita, Tosu; Katsumi Aoki, Kumamoto, all of Japan

[73] Assignee: Sanko Co., Ltd., Fukuoka, Japan

[22] Filed: Dec. 10, 1974

[21] Appl. No.: 531,492

[30] Foreign Application Priority Data

| | | |
|---|---|---|
| Dec. 11, 1973 | Japan | 48-139112 |
| Feb. 9, 1974 | Japan | 49-16514 |
| Mar. 30, 1974 | Japan | 49-36801 |
| July 19, 1974 | Japan | 49-83699 |
| Aug. 15, 1974 | Japan | 49-94041 |
| Sept. 24, 1974 | Japan | 49-110129 |

[52] U.S. Cl. ..... 180/1 VS; 51/8 R; 180/7 R

[51] Int. Cl.[2] ..... B60S 3/02

[58] Field of Search ..... 51/9 M, 8 R, 12; 180/1 R, 1 US, 7 R, 8 R

[56] References Cited

UNITED STATES PATENTS

| | | | |
|---|---|---|---|
| 2,104,062 | 1/1938 | Temple | 180/7 R X |
| 2,118,276 | 5/1938 | Temple | 180/7 R X |
| 2,596,322 | 5/1952 | Zumwalt | 180/1 R X |
| 3,147,143 | 9/1964 | Kontani | 51/9 M X |
| 3,409,854 | 11/1968 | Swallert | 51/9 M X |
| 3,690,393 | 9/1972 | Guy | 180/1 R |
| 3,777,834 | 12/1973 | Hiraoka | 180/1 US X |
| 3,788,010 | 1/1974 | Goff | 51/9 M |
| 3,864,876 | 2/1975 | Diehn | 51/9 M |

*Primary Examiner*—M. H. Wood, Jr.
*Assistant Examiner*—Terrance L. Siemens
*Attorney, Agent, or Firm*—Frank J. Jordan

[57] ABSTRACT

The present invention relates to an apparatus movably adhering to a wall and which may include a cleaning apparatus or coating apparatus affixed thereto for removing rust and paint from the vertical or inclined walls of large structures such as ships, oil-tanks or the like or for finishing bead welds thereon, and more particularly to an apparatus movable along a wall comprising four magnetic or vacuum adhering members which alternately adhere to the wall two by two as they are operated by remote-control to move the apparatus in the desired direction on the vertical or inclined wall.

18 Claims, 22 Drawing Figures

71
41
46
80
1(MG1)
12
83
5
W
S/2
40
74
78
44
79
4(MG4)

1(MG1)
2(MG2)
3(MG3)
4(MG4)
LS1
LS2
12
5
79
9
6
6'
7
8
10
16
40
41
42
43
44
80
81
82
83

1(MG1)
W
46
5
96
97
112'
114
112
61
98
102
97
111
113
103
99
100
104
105
P1
P2
105
101
106
106
46
4(MG4)
61
115
107
108
110
109

1(MG1)
2(MG2)
7
90
12
14
15
113
15
112
14
90
4(MG4)
91
111'
114
5
113'
10
3(MG3)
115
106
106
115
107
109
109
107
109
107
109

APPARATUS MOVABLY ADHERING TO A WALL AND ADAPTED TO CARRY A CLEANING APPARATUS

BACKGROUND OF THE INVENTION

The present invention relates to an apparatus movably adhering to the vertical or inclined walls of large structures such as ships, oil-tanks or the like and movable in the desired direction by applying magnetic or vacuum adhering means thereto.

Conventionally, various apparatus for moving on the walls in the desired direction by remote-control and having affixed thereto a cleaning apparatus such as a steel grit blasting device or coating device have been proposed for the purpose of removing rust, stains and paint from the walls of the aforementioned large structures or for finishing and coating bead welds thereon. The above-mentioned conventional apparatus, however, have the following common disadvantages. Firstly, though they utilize the attractive force of electro-magnets or vacuum, the above attractive force is employed to the extent of preventing them from separating from the walls freely and they are not employed effectively and positively. Accordingly, they do not always hold and attain a complete adhering condition to the walls. It is a matter of general knowledge that the magnetic force falls off extremely in inverse proportion to the space or distance between the magnet and the wall, as shown in FIG. 4. Therefore, it is desired to utilize the character of a magnet as much as possible and this is the same with regard to the vacuum force.

Secondly, due to the incomplete utilization of the above attractive force, the hoisting and shifting device for suspending and leading the above movable apparatus and the cleaning apparatus are indispensable to avoid having the movable apparatus fall along with the cleaning apparatus in the case where the latter is used. That is, it is necessary to set up hoisting and shifting device on the deck or to provide cranes in the vicinity of the walls. This results in the working condition becoming burdensome, so that it is desired to simplify and omit these preparative conditions as much as possible.

Thirdly, conventional movable apparatus can scarcely move on curved or uneven walls such as the bow or the stern of a ship's hull. Therefore, these conventional movable apparatus could not improve their working efficiency contrary to expectations, and have been employed within narrow limits because of the above mentioned disadvantages.

SUMMARY OF THE INVENTION

An object of the present invention is to overcome the disadvantages of these known prior art arrangements and to provide a movable apparatus suitably adapted to be equipped with various cleaning apparatus and able to move by itself in the desired direction holding in a complete adhering condition to the walls of large structures by remote-control.

Another object of the present invention is to provide a movable apparatus without requiring the above mentioned hoisting and shifting device, thereby simplifying the preparative operable conditions except for the minimum suspending means for preventing a fall in the event of an accident.

A further object of the present invention is to provide a movable apparatus which can move on the curved or uneven walls such as the bow and the stern of a ship's hull.

A still further object of the present invention is to provide a movable apparatus equipped with a grit blasting cleaning apparatus in order to perform cleaning operations.

The aformentioned objects are achieved by providing an apparatus movably adhering to a wall and comprising a body adapted to move along the wall, two pairs of adhering devices selectively operable to adhere to the wall, operable means operably mounting the two pairs of adhering devices on the body such that the adhering devices are movable in parallel directions with the two adhering devices in each pair being movable in opposite directions relative to one another, drive means for interlockingly driving the operable means in parallel and opposite movable directions, and means for selectively switching the adhering devices on and off such that the adhering devices are operable to adheringly move the body along the wall.

The body may have mounted thereon cleaning apparatus comprising an abrasive blasting chamber adapted to be disposed adjacent to the wall and having an opening which opens up to the wall, flexible sealing means about the opening, blasting nozzles in the blasting chamber operable to direct a stream of abrasive material through the opening onto the wall, a pressure tank mounted on the body below the blasting chamber such that the spent abrasive material passes to the pressure tank, means connected to the pressure tank and operable to conduct abrasive material from the pressure tank to the nozzle, and operable means within the tank operable to admit the spent abrasive material into the pressure tank without impairing the pressurized condition of the latter.

Other objects, features, and advantages of the present invention will become more apparent by referring to the following detailed description and appended drawings.

PREFERRED EMBODIMENTS OF THE INVENTION

THE FIRST EMBODIMENT (FIGS. 1–3)

Figure 1:
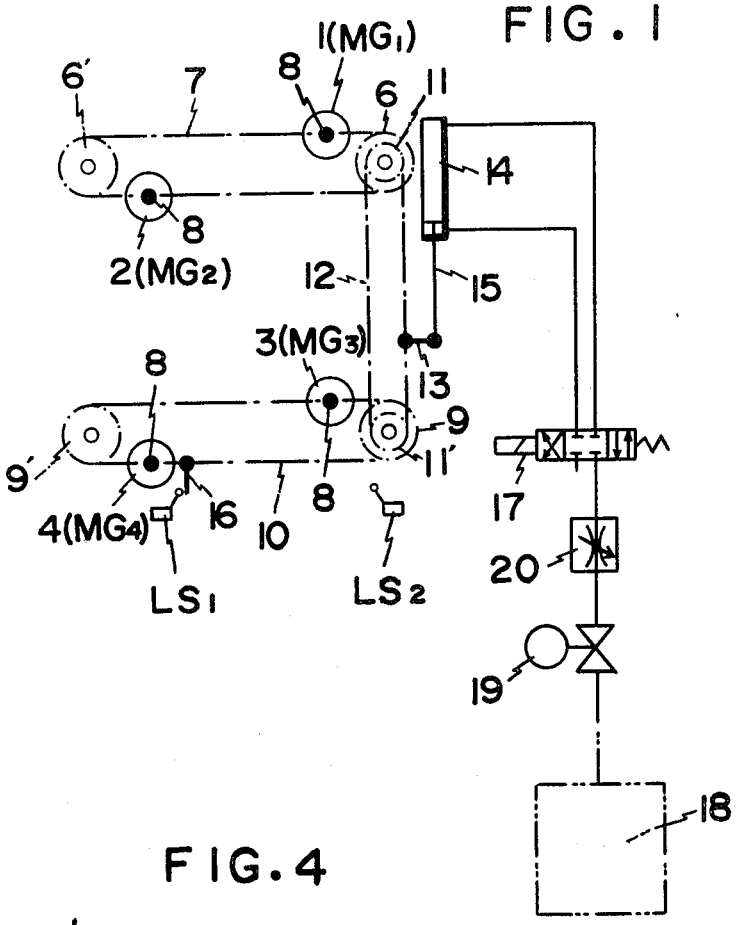
FIG. 1 is an explanatory schematic diagram of a movable apparatus according to a first embodiment of the present invention showing the principle of operation of the adheringmoving mechanism.

As shown in FIG. 1, the movable apparatus of the first embodiment is provided with four adhering members 1, 2, 3 and 4, which adhere to the wall W (FIG. 3) of large structures such as ships or oil tanks. The four adhering members 1, 2, 3, and 4 comprise four electromagnets $MG_1$, $MG_2$, $MG_3$, and $MG_4$ respectively, one pair of which ($MG_1$ and $MG_2$) are, by means of pins 8, respectively connected to an endless chain 7 extending between a right sprocket 6 and a left sprocket 6' mounted on a body 5 in such a way that $MG_1$ and $MG_2$ are driven in opposite directions; the other pair of electro-magnets $MG_3$ and $MG_4$ are, by means of pins 8, respectively connected to another endless chain 10, which is parallel to the first endless chain 7 and which extends between a right sprocket 9 and a left sprocket 9' also mounted on the body 5 in such a way that $MG_3$ and $MG_4$ are driven in opposite directions.

Figure 2:
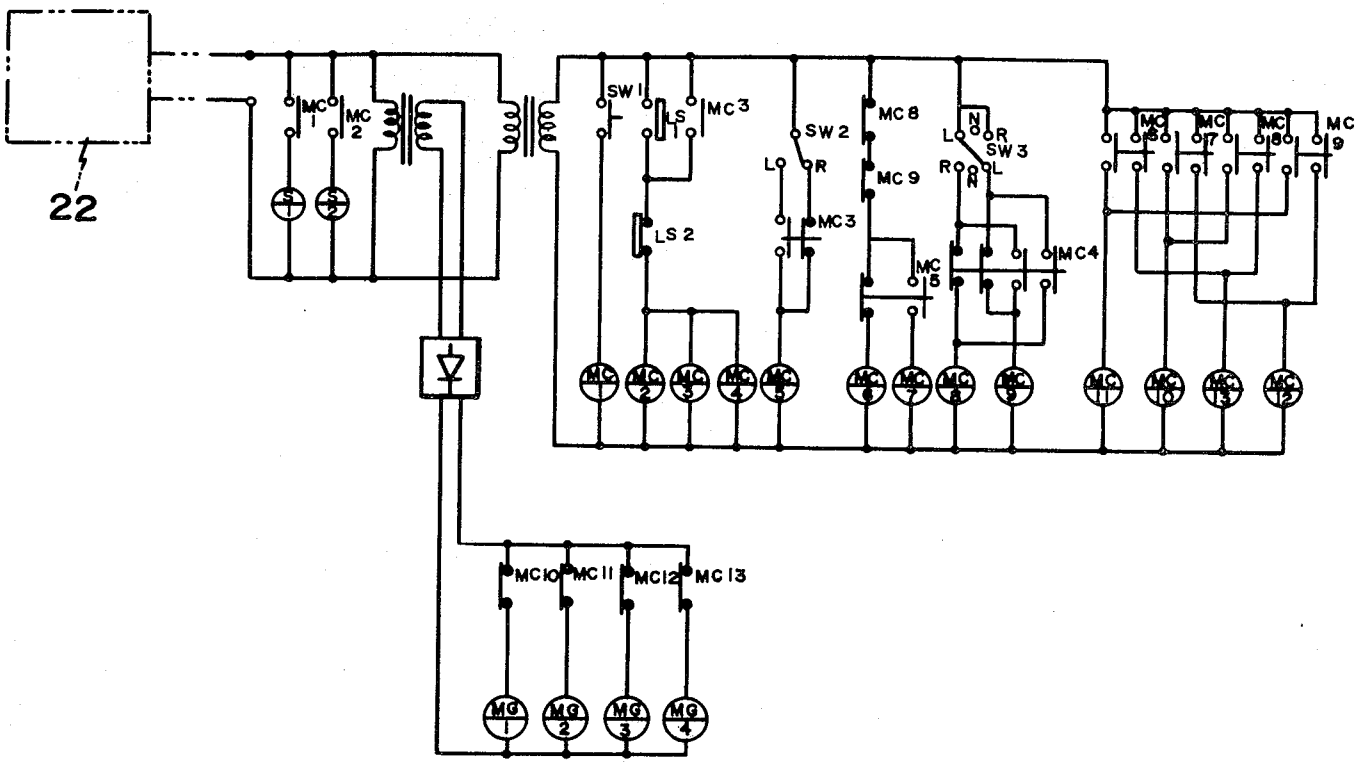
FIG. 2 is a circuit diagram for effecting remote-control of the movable apparatus of the first embodiment.

In order to drive the endless chains 7 and 10 interlockingly, an interlocking or driving chain 12 extends between other sprockets 11 and 11 respectively fixed to the axes of sprockets 6 and 9. Moreover, the chain 12 is provided with a connecting member 13 on one side thereof in such a way that the connecting member 13 is connected to the end of a piston rod 15 of a driving cylinder 14 which in turn is driven by a controlled power source such as compressed air or the like. Either one of the two endless chains, for example in this first embodiment the endless chain 10, is provided with a switching member 16. Within the path of movement of the switching member 16 there are provided limit switches $LS_1$ and $LS_2$ which are affixed to the body 5, whereby upon the rotation of the endless chain 10, the switching member 16 contacts alternatively the above limit switches $LS_1$ and $LS_2$ to change over a four-ported solenoid valve 17. Accordingly, activation of the limit switches $LS_1$ and $LS_2$ controls the flow of compressed air supplied to the driving cylinder 14, and the excitation and the demagnetization of the electro-magnets $MG_1$, $MG_2$, $MG_3$, and $MG_4$ are repeatedly alternatively in accordance with a certain order as shown in FIG. 2 and as set forth in the following description. In FIG. 1, reference numeral 18 indicates a compressor, 19 indicates a two-ported valve, and 20 indicates a flow regulator valve.

Referring to FIG. 2, $S_1$ is a coil for the two-ported solenoid valve 19, $S_2$ is a coil for the four-ported solenoid valve 17, $MC_1$, $MC_2$, $MC_3$ . . . $MC_{13}$ are electromagnetic contactors, and $SW_1$, $SW_2$, and $SW_3$ are switches mounted on a control panel 21 (illustrated in FIG. 3) as will be described in greater detail hereinafter. The two-ported solenoid valve 19 is switched on and off by $SW_1$ in order to move or stop the body 5. $SW_2$ is the rotary switch for changing the direction of movement in a right and left direction, $SW_3$ is the switch for changing the direction of movement in an upward and downard direction according to the position of the body 5, and the numeral 22 indicates an alternating current source.

Figure 3:
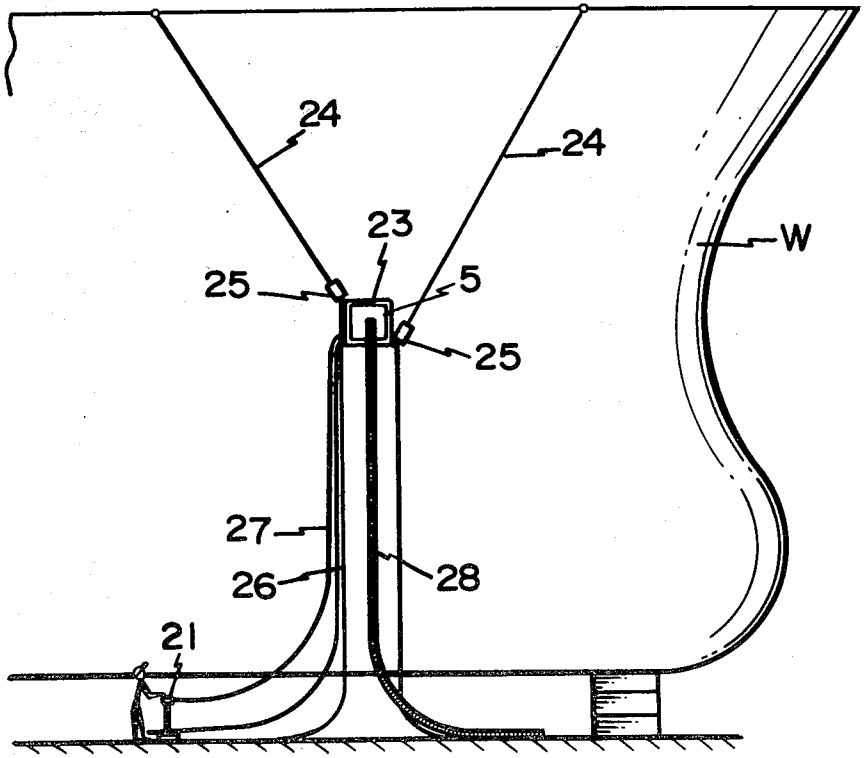
FIG. 3 is an elevational view and explanatory diagram showing the adhering-moving mechanism operable to effect cleaning operations on the sides of a ship's hull.

Referring to FIG. 3, this is shown as a cleaning operation for the wall or hull of a ship by employing the movably adhering apparatus of the present embodiment equipped with a cleaning device such as the grit blasting apparatus. The numeral 23 indicates a cleaning apparatus. One end of a rope 24 for preventing the present movably adhering apparatus from falling down is fastened to the edge of the deck at the desired intervals, and the other end of the rope is attached to the body 5 through a conventional connector 25, thereby preventing accidental falling of the apparatus. The connector 25 comprises means for holding the rope 24 when the falling speed of the apparatus comes up to more than a prescribed or predetermined value. The numeral 26 indicates a cable for an electric source, 27 indicates a cable for operating means, and 28 indicates a flexible duct or hose connected to dust collector (not shown in FIG. 3).

The working system of each part of the present movably adhering apparatus will now be described concretely with reference to FIG. 2 wherein a symbol in each circle indicates a coil of an electromagnet switch and symbols which are not circled indicate positions which are activated by supplying current to the above coils.

At first, in case of moving the body 5 in the right hand direction, $SW_2$ is switched to the R position and $SW_3$ is kept in the N or neutral position. $SW_1$ is switched on to operate the electromagnet $MC_1$, and then the electromagnet coil $MC_1$ is activated to switch on $S_1$ whereby the two-ported solenoid valve 19 is opened and the driving cylinder 14 is supplied with compressed air to extend the piston rod 15 so that chain 12 is driven to drive endless chains 7 and 10 whereby electro magnets $MG_1$ and $MG_3$ move to the right and electro-magnets $MG_2$ and $MG_4$ move to the left. In this case, only electro-magnets $MG_2$ and $MG_4$ are energized and adhere to the wall W owing to the successive operations of $MC_5$, $MC_7$, $MC_{10}$ and $MC_{12}$. Thus the body 5 moves on the walll W in the right direction.

Secondly, as the body 5 moves on the wall W adhering thereto in the right direction, the contact of the limit switch $LS_1$ which is attached to the body 5 is switched on by being contacted by the switching member 16, and then $MC_2$ and next the four-ported solenoid valve 17 of $S_2$ are successively operated, whereby the piston rod 15 of the driving cylinder 14 begins to be withdrawn so that the moving direction of the electro-magnets are changed in such a way that $MG_1$ and $MG_3$ now move to the left and $MG_2$ and $MG_4$ move to the right. Moreover, when the limit switch $LS_1$ is switched on $MC_5$ is deactivated and has stopped its working as a result of $MC_3$ operating and $MC_6$ is also operated instead of $MC_7$, whereby $MC_{11}$ and $MC_{13}$ are operated successively to make operate electro-magnets $MG_1$ and $MG_3$ adhere to the wall W. Thus the body 5 continues to move in the right direction.

Thirdly, when the contact of the limit switch $LS_2$ is switched off by being contacted by the switching member 16, $MC_3$ is deactivated and has stopped its working and switched off at its contact so that the operating condition becomes the same as the initial one and the piston rod 15 of the driving cylinder 14 begins to extend again, whereby electro-magnets $MG_2$ and $MG_4$ adhere to the wall and the body 5 similarly continues to move in the right direction. As mentioned above, the body 5 continues to move in the right direction repeating the aforementioned operations.

In the case of moving the body 5 in the left hand direction, since the operation is effected in the same manner as described above except that $SW_2$ is switched to the L position, a description regarding movement of the body 5 to the left is omitted.

In the case of changing the direction of the body 5 to an upward or downward movement, the switch $SW_3$ on the control panel 21 is changed over. At first, when changing a right movement to an upward movement, $SW_3$ is changed from the N or neutral position to the L position. In this case wherein the limit switch $LS_1$ is switched off, if $MC_2$, $MC_3$ and $MC_4$ are not operated, limit switch $LS_1$ is switched on to energize the two port solenoid valve 19 when S1 is switched on whereby the piston rod 15 of the driving cylinder 14 extends outwardly and electro-magnets $MG_1$ and $MG_3$ move to the right while electro-magnets $MG_2$ and $MG_4$ move to the left. $MC_4$ is not operated, so $MC_9$, $MC_{11}$ and $MC_{12}$ are operated successively, whereby electro-magnets $MG_1$ and $MG_4$ adhere to the wall W. Therefore, the upper part of the body 5 moves to the left while, on the other hand, the lower part of the body 5 moves to the right so that the body 5 is in the position of being inclined to the left at its upper part. Subsequently, the moving direction may be changed to an upwardly right inclined direction by switching $SW_3$ to the N or neutral position. As regards changing the right hand movement to a downwardly inclined right movement, or the left movement to an upwardly inclined left movement or a downwardly inclined left movement, the changing operation can be made in the same manner as mentioned above, so that the operating description thereof is omitted.

As mentioned above, in the present first embodiment, it is apparent that the apparatus can move continuously along the walls in the desired direction while adhering thereto by remotely controlling the four electro-magnets affixed to the endless chains in such a way that each pair of the four electro-magnets alternatively adhere magnetically to the walls and prevents the apparatus from falling by means of the magnetic force.

Further, in the first embodiment, although electro-magnets are employed as the adhering members to the wall, alternatively, it is possible to move the apparatus by employing vacuum adhering members instead of the electroc-magnets while making vacuum inspiration and expiration respectively correspond to the magnetic excitation and demagnetization.

THE SECOND EMBODIMENT (FIGS. 5–7)

The object of the second embodiment is to provide an apparatus movably adhering to the walls by means of electro-magnets for various working devices such as cleaning devices which are employed in the hoisted and suspended condition.

Figure 5:
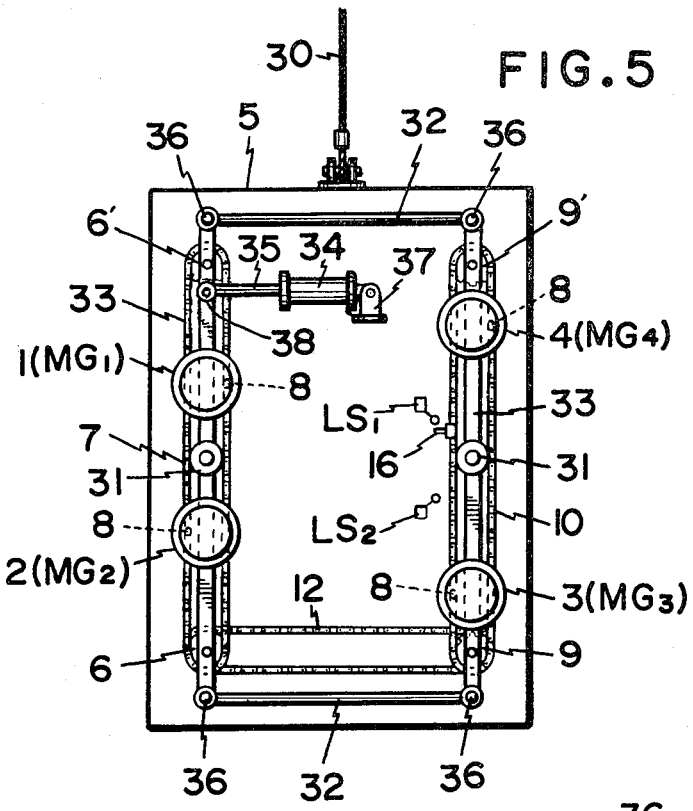
FIG. 5 is an elevation showing a movable apparatus according to a second embodiment of the present invention.
Figure 6:
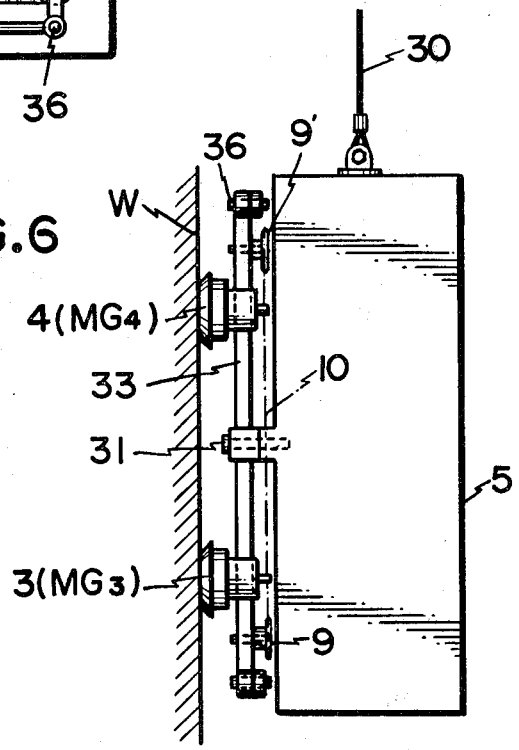
FIG. 6 is a side view of the second embodiment.

As shown in FIGS. 5 and 6, a body 5 which moves up and down is suspended by a wire rope 30 comprising two electromagnetic sliding guides 33 confronting a steel wall W. Each sliding guide 33 has a center which is respectively supported by a supporting axis 31 and both ends of each sliding guide 33 are connected to two rods 32 so as to be able to pivot together at the connecting points. The angle formed by the guide 33 and the body 5 can be freely altered by the action of a piston rod 35 of a pneumatic or hydraulic cylinder 34. The numeral 36 indicates a pin connecting the rods 32 to the guides 33 so as to provide free pivotal movement therebetween and 37 indicates a support fixed to the body 5 for mounting the cylinder 34. The numeral 38 indicates a pin connecting the guide 33 to the piston rod 35 of the cylinder 34. Moreover, the above two guides 33 respectively have two pairs of electro-magnets $MG_1$ and $MG_2$ as well as $MG_3$ and $MG_4$ movable upwardly and downwardly as the adhering members 1, 2, 3 and 4, and these electro-magnets are fixed to endless chains 7 and 10 by means of pins 8 in the same manner as those of the first embodiment. Each pair of electro-magnets $MG_1$, $MG_2$, and $MG_3$, $MG_4$ slide in opposite directions relative to each other on the guides 33.

Figure 7:
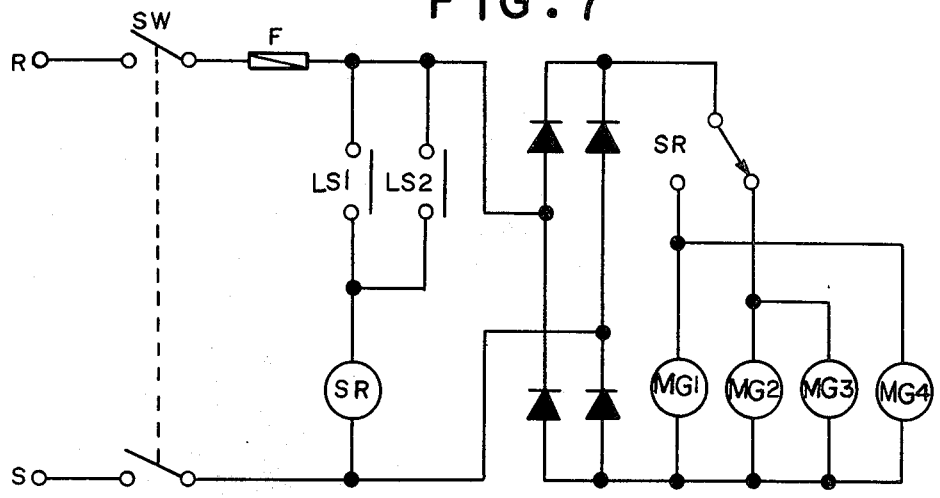
FIG. 7 is a circuit diagram for effecting remote-control of the movable apparatus of the second embodiment.

In this second emodiment, a switching member 16 fixed to the endless chain 10 lies between limit switches $LS_1$ and $LS_2$ which are mounted on the body 5, and when the rotary element of a stepping relay SR is in the position as shown in FIG. 7, electro-magnets $MG_2$ and $MG_3$ are excited by the switching on of the switch SW and adhere to the steel walls W. When the body 5 is to be moved upwardly while being suspended by the rope 30 linked to the movable hoisting device, the switching member 16 moves downwardly relative to the body 5 because electro-magnets $MG_2$ and $MG_3$ adhere to the wall W and do not move. Subsequently, the limit Switch $LS_2$ is switched on by the downwardly moving switching member 16 and the stepping relay SR is activated to step the rotary element thereby whereby electro-magnets $MG_2$and $MG_3$ are demagnetized and electro-magnets $MG_1$ and $MG_4$ are excited to adhere to the wall W. Therefore, the body 5 continues to move upwardly because electro-magnets $MG_1$ and $MG_4$ do not move, and the switching member 16 also moves upwardly and operates the limit switch $LS_1$ to activate the stepping relay SR, and then the above mentioned operations are repeated. Furthermore, the description regarding the operation of the electro-magnets in the case when the body 5 moves downwardly will be omitted because such operation will be clear with reference to FIG. 7.

In those cases where it is desired to change the moving direction of the body 5 to transfer it to a desired position, the piston rod 35 of the cylinder 34 may be extended or withdrawn so that the angle formed by the guide 33 and the body 5 is altered, thereby changing the direction of movement of the electro-magnets. In this latter case, the body 5 moves in the direction of the inclination of the guide 33. Accordingly, the body 5 can be transferred to the desired position by repeating the inclination of the guide 33 and the upward and downward movement of the body 5 caused by hoisting with the wire rope 30.

Further, although in this second embodiment, the movement of the movable apparatus adhering to the wall is operated by the hoisting device, the apparatus in this second embodiment can move by itself, by being provided with the driving cylinder 14 as shown and described in the first embodiment instead of the hoisting device.

THE THIRD EMBODIMENT (FIGS. 8–12)

AS show in FIGS. 8 – 12, the movable apparatus in this third embodiment moves adheringly to the walls in a manner in which the four adhering members securely adhere to the wall while being separated from the wall at a constant spaced distance without being influenced by the surface condition of the wall by making the four adhering member 1, 2, 3 and 4 comprising electro-magnets or permanent magnets possible to move independently on the steel wall W.

Figure 8:
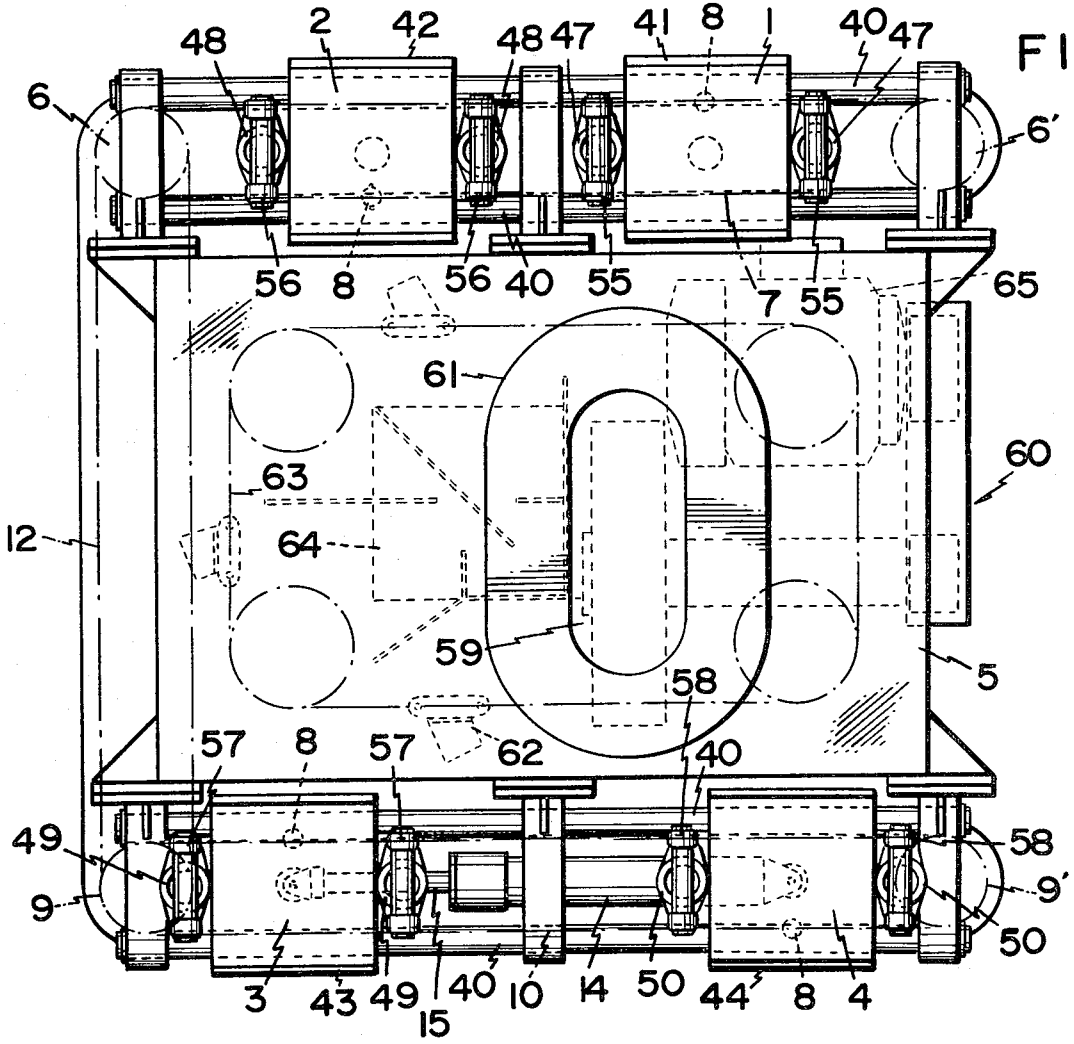
FIG. 8 is an elevation showing a movable apparatus according to a third embodiment of the present invention.
Figure 9:
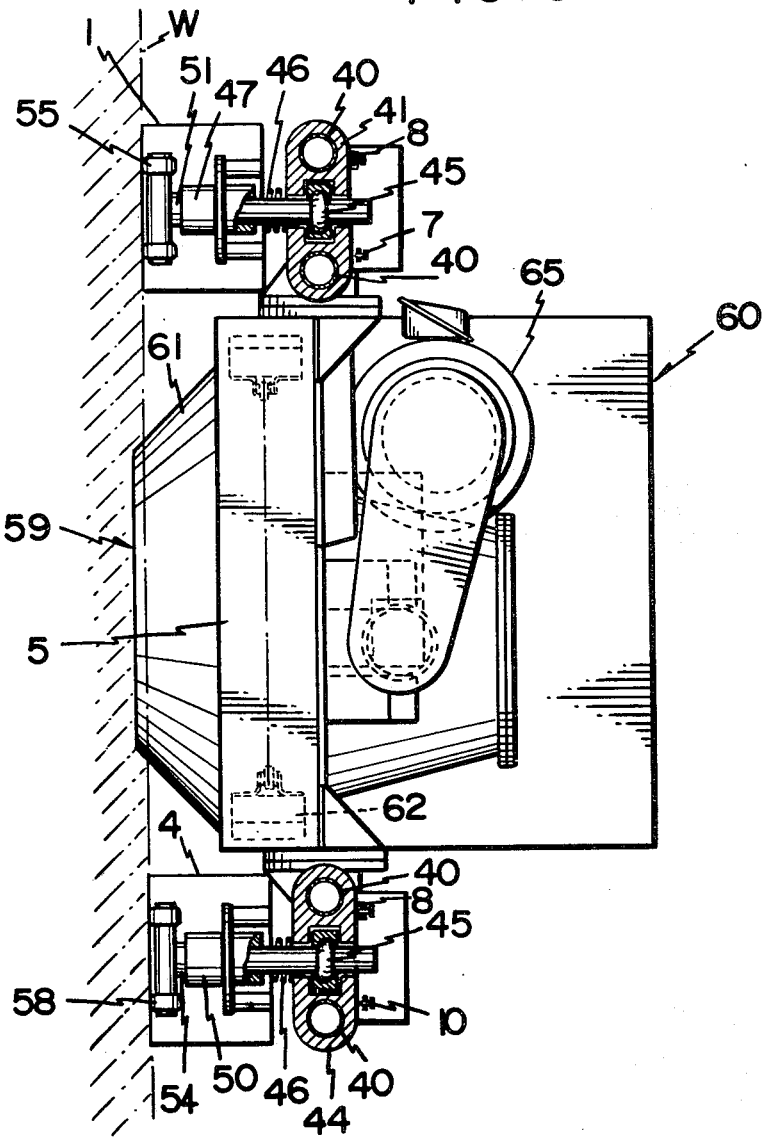
FIG. 9 is a side view, partly in section, of the third embodiment.

Referring to FIGS. 8 and 9, four sliding bases 41, 42, 43, and 44 are slidable along guides 40 fixed to the body 5. The four sliding bases 41, 42 and 43, 44 are affixed to the endless chains 7 and 10 respectively in such a way that two pairs thereof which respectively slide on the same guide 40 move in the opposite direction relative to each other and the adhering members 1, 2, 3, and 4 are respectively attached to the above sliding bases 41, 42, 43, and 44 by interposing a restoring spring 46 and by means of spherical roller bearings 45 so as to be universally movable. Moreover, hydraulic cylinders 47, 48, 49, and 50 are fixed to the respective adhering members 1, 2, 3, and 4 at both ends, and rollers 55, 56, 57, and 58 are respectively affixed to the ends of piston rods 51, 52, 53, and 54 of the above cylinders 47, 48, 49, and 50 so as to push against the wall W and separate the adhering members 1, 2, 3, and 4 from the wall W at a constant spaced distance, thereby overcoming difficulties while moving along the wall W. Furthermore, in order to move the adhering members 1, 2, 3, and 4, the end of a hydraulic driving cylinder 14 is pivotally secured to the sliding base 44 and the end of the piston rod 15 of the above cylinder 14 is pivotally secured to the sliding base 43. The remaining mechanism relative to the movement of this apparatus are the same as the aforementioned embodiments and accordingly similar reference numerals are used.

In FIGS. 8 and 9, the numeral 59 indicates a steel grit or sand blasting nozzle of a cleaning device 60 affixed to the body 5, 61 indicates a flexible sealing member preventing the above steel grit from leaking out, 62 indicates a bucket for collecting the steel grit and resupplying it to the blasting apparatus, 63 indicates a chain for turning the bucket 62, 64 indicates a shoot for the steel grit, and 65 indicates a driving motor for the grit blasting apparatus.

Figure 10:
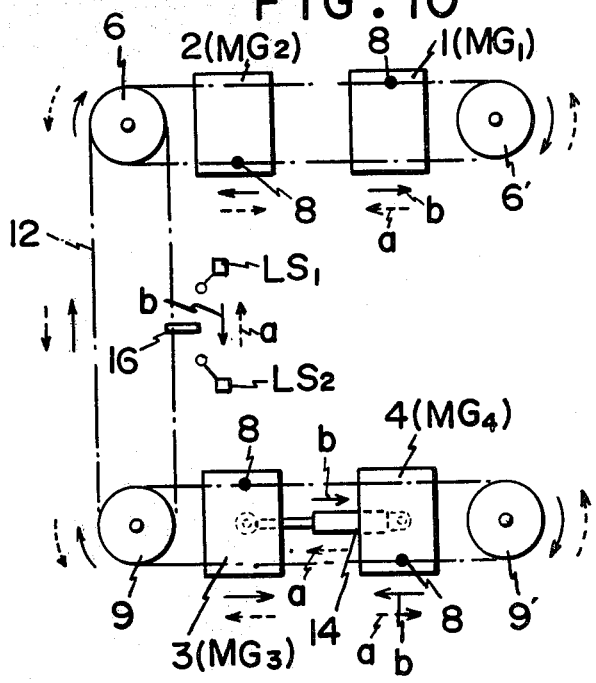
FIG. 10 is a schematic view and an explanatory diagram showing the adhering-moving mechanism of the third embodiment.

The operational movement of the electro-magnets $MG_1$, $MG_2$, $MG_3$, and $MG_4$ respectively correspond to the adhering member 1, 2, 3, and 4 will now be described with reference to FIGS. 10 to 12.

Figure 11:
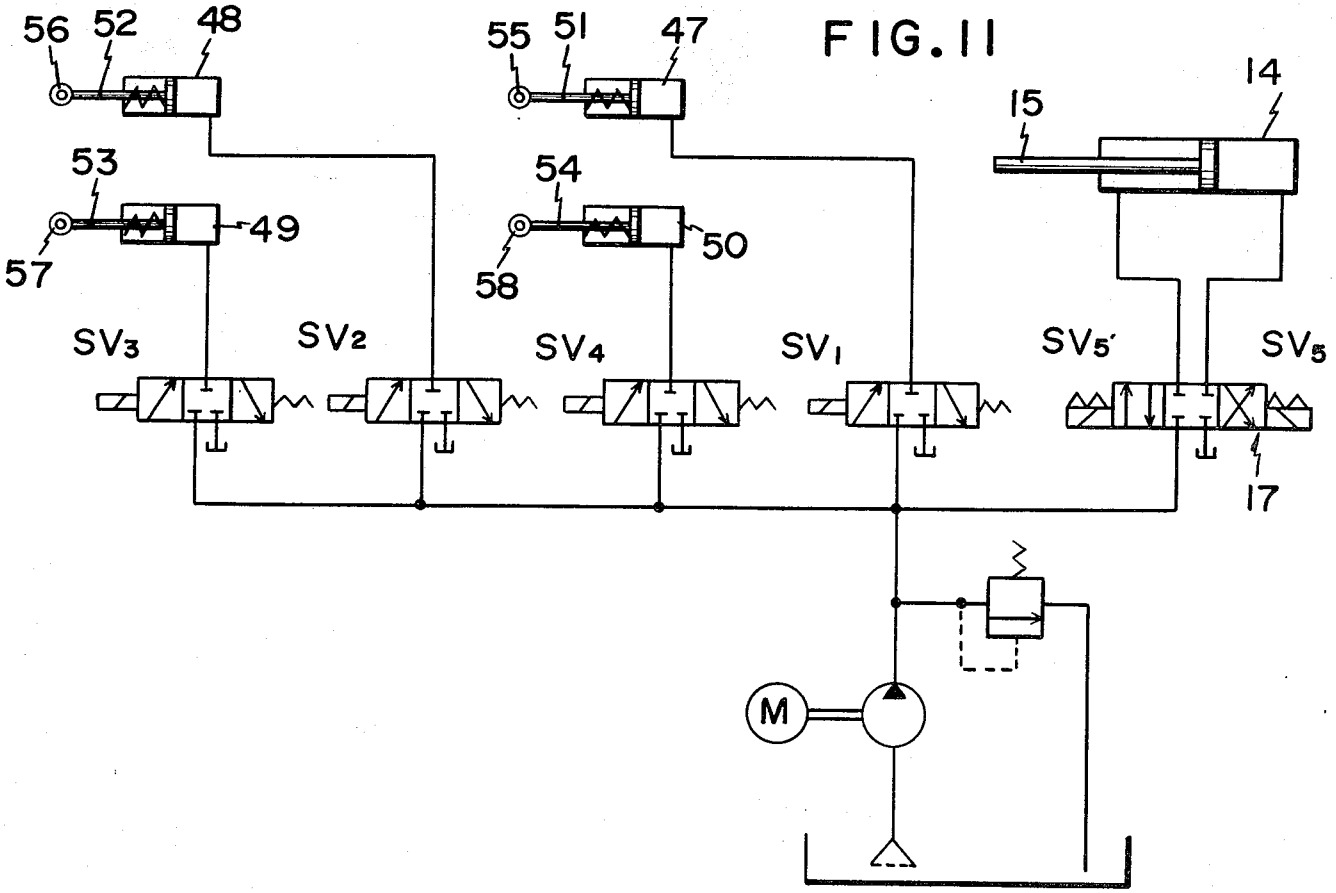
FIG. 11 is a schematic circuit diagram showing the hydraulic control of the third embodiment.
Figure 12:
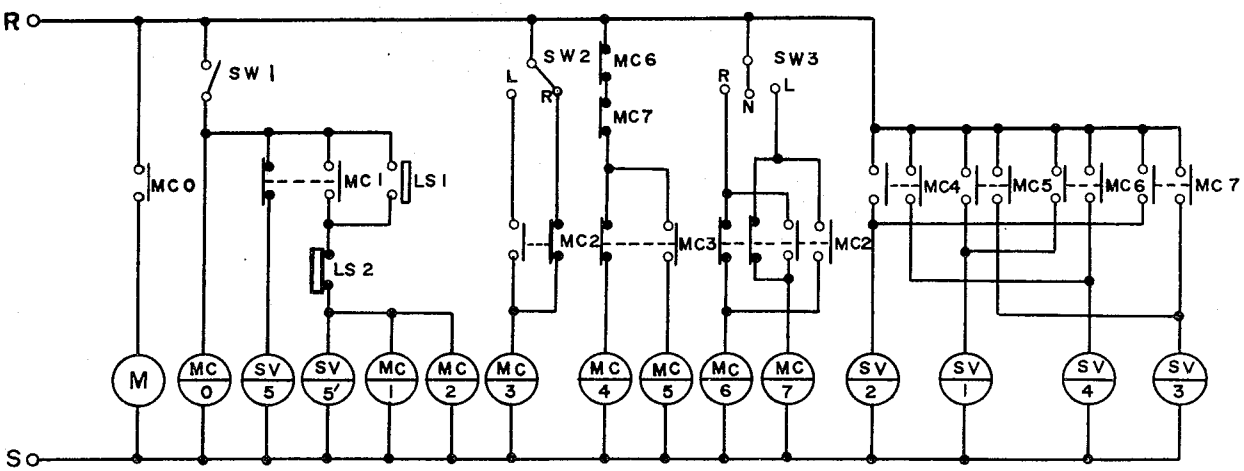
FIG. 12 is a schematic circuit diagram showing the electric control of the third embodiment.

At first, in the case of moving the body 5 in the right hand direction, as shown in FIG. 12 on the control panel 21, the switch $SW_2$ for moving the body 5 to the right and left is switched to the R position and the switch $SW_3$ for changing the moving direction of the body 5 is kept in the N or neutral position. Then switch $SW_1$ is switched on to operate the electro-magnetic contactor $MC_0$ and SV5. By the above operation of $MC_0$, a hydraulic pump driving motor M is started. The four-ported solenoid valve 17 (FIG. 11) of the hydraulic cylinder 14 is changed to the position of $SV_5$, so that the piston rod 15 is extended in the direction of the arrow *a* (FIG. 10) to move the adhering member 3 to the left and the adhering member 4 to the right as shown in FIG. 10, and at the same time, the adhering member 2 moves to the right and the adhering member 1 moves to the left. In this case, $SW_2$ and MC2 are switched on so that $MC_3$ (FIG. 12) is operated and next $MC_5$ is operated to open the three-ported solenoid operated valves $SV_1$ and $SV_3$ (FIG. 11), whereby the rollers 55 and 57 respectively connected to the piston rods 51 and 53 of the hydraulic cylinders 47 and 49 are moved back, so that only the adhering members 1 and 3 adhere to the steel wall W and the adhering members 2 and 4 are separated from the wall at a constant spaced distance by the rollers 56 and 58. Therefore, the body 5 moves in the right direction.

Secondly, as the body 5 continues to move on the wall in the right hand direction adhering to the wall, the limit switch $LS_1$ is ultimately switched on by the switching member 16 fixed to the interlocking chain 12, and then SV5; MC1 and MC2 are operated to change the four-ported solenoid operated valve 17 of the hydraulic cylinder 14 to the position of $SV_5$, (FIG. 11) from that of SV5 so that the piston rod 15 is withdrawn in the direction of the arrow *b* (FIG. 10), to move the adhering members 1 and 3 to the right and the adhering members 2 and 4 to the left. In this case $MC_2$ is operated instead of $MC_3$, and $MC_4$ is also operated instead of $MC_5$ as $MC_3$ returns to the original position. Therefore, the solenoid operated valves $SV_2$ and $SV_4$ are opened and then the rollers 56 and 58 are moved back, whereby only the adhering members 2 and 4 adhere to the steel wall W and at the same time the rollers 55 and 57 are extended out by means of the restoring springs 46 by switching the three-ported solenoid operated valves $SV_1$ and $SV_3$, whereby the adhering member 1 and 3 are separated from the wall W at a constant, spaced distance. The above-mentioned operations are repeated and the body 5 continuously moves in the right direction while adhering to the wall W.

Further, regarding the movement of the body 5 in the right hand direction or the change of the moving direction, it is apparent that the above operations can be carried out, as shown in FIGS. 11 and 12, according to the first embodiment.

As mentioned above, since the freely movable rollers are arranged on both sides of the adhering members, even if the adhering members are permanent magnets, these adhering members can move on the wall adhering thereto and can securely adhere to the wall, being out of danger of falling in case of electricity failure with little production of unbalance in their adhering energy becuase they are separated from the wall at a constant spaced distance without being influenced by the surface condition of the wall.

THE FOURTH EMBODIMENT (FIGS. 13 – 16)

In the aforementioned embodiments the adhering members are arranged to confront the wall in a close condition, however, in the present fourth embodiment, the adhering members are adhered to the wall in a pressured condition for the purpose of preventing one pair of adhering members which do not adhere to the wall from being unable to keep a constant spaced distance from the wall because of the movement caused by the weight of the working apparatus affixed to the body 5.

Figure 14:
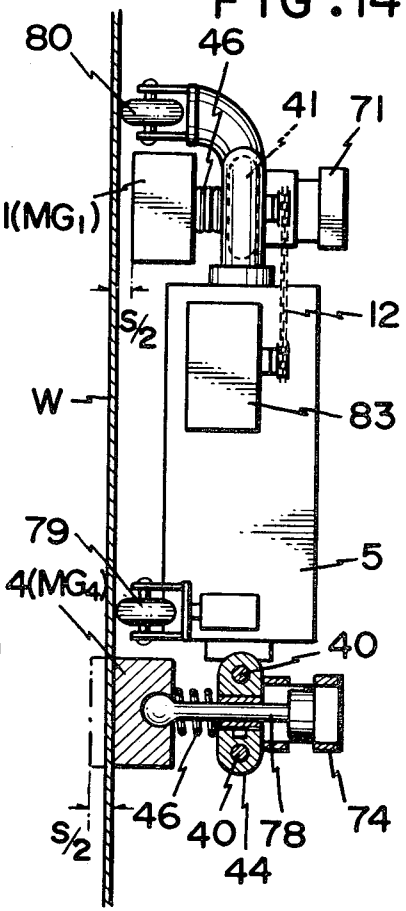
FIG. 14 is a side view, partly in section, of the fourth embodiment.
Figure 13:
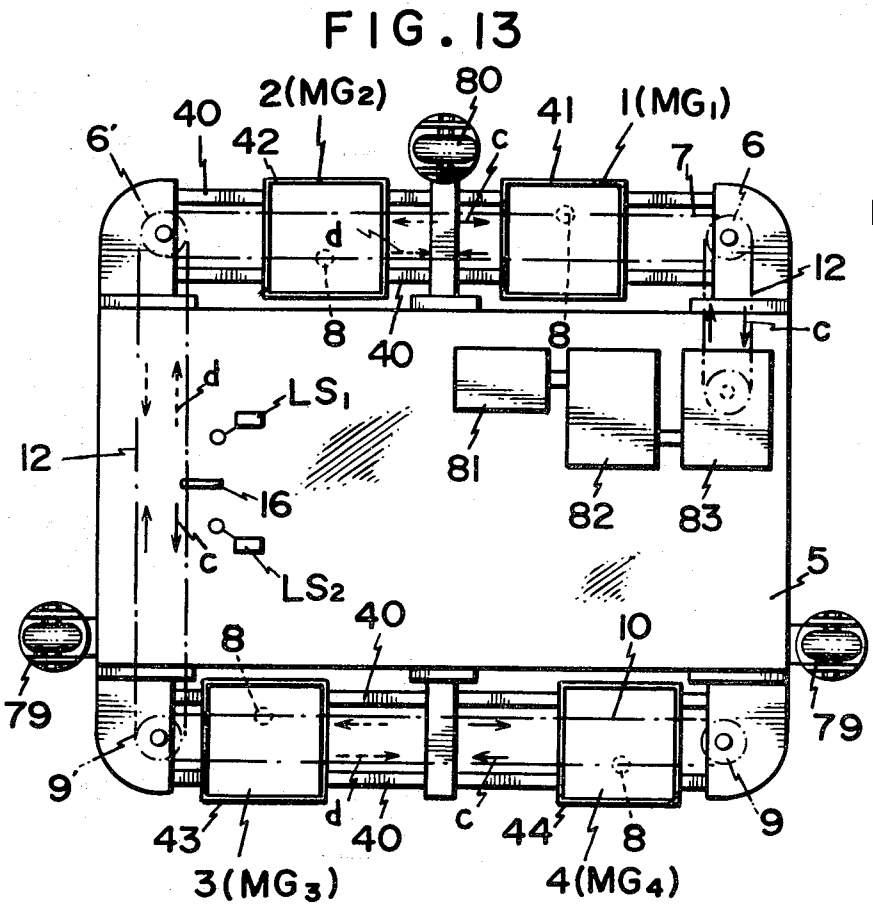
FIG. 13 is an elevation showing a movable apparatus according to a fourth embodiment of the present invention.

As show in FIGS. 13 and 14, four sliding bases 41, 42, 43, and 44 are slidable along guides 40 mounted on the body 5 and there passes these through piston rods 75, 76, 77 and 78 of pneumatic cylinders 71, 72, 73 and 74 which are fixed to the sliding bases. Four adhering members 1, 2, 3, and 4 respectively comprise electro-magnets $MG_1$, $MG_2$, $MG_3$, and $MG_4$ which are affixed to the tops of the above piston rods 75, 76, 77 and 78, and there is interposed a restoring spring 46 so as to be movable universally. The adhering faces of the above adhering members 1, 2, 3, and 4 may project beyond or away from the wall W because of the above universally movable roller 79 and the pivotally secured supporting roller 80. It is preferable to set up the stroke S of the piston rods 75, 76, 77, and 78 in such a way that the contact surface of the supporting rollers 79 and 80 to the wall W becomes the center of the above stroke S as indicated in FIG. 14.

Further, in this fourth embodiment, electro-magnets are employed as the adhering members, however, it is possible to attain a similar objective by employing a vacuum adhering means. In FIGS. 13 to 16, 81 indicates a driving motor for driving the sliding bases, 82 indicates a magnetic clutch comprising a right rotation transmitting clutch SCR and a left rotation transmitting clutch SCL, and 83 indicates a reduction device.

The operational movement of this fourth embodiment will now be described with reference to FIGS. 15 and 16.

At first, in case of moving the body 5 in the right hand direction, on the control panel 21 (FIG. 3) the switch $SW_3$ for changing the moving direction of the body 5 is kept in the N or neutral position and the switch $SW_1$ is switched on so all electro-magnets $MG_1$, $MG_2$, $MG_3$, and $MG_4$ respectively corresponding to the adhering members 1, 2, 3, and 4 adhere to the wall W and at the same time the three-ported solenoid operated valves $SV_1$, $SV_2$, $SV_3$, and $SV_4$ are entirely opened. That is, in this case, the piston rods 75, 76, 77 and 78 of the pneumatic cylinders 71, 72, 73, and 74 are operated in the direction moving back from the wall W, and since the separating force of the electro-magnets caused by the pneumatic cylinder is much less in comparison with the adhering force of electro-magnets, the body 5 is powerfully pressed against the wall W by means of the supporting rollers 79 and 80. Under the above condition, when the switch $SW_2$ for moving the body 5 to the right and the left is switched to the R position, the electro-magnetic contactor $MC_1$ is operated to start the motor 81. At the same time, relays are successively operated in such a way that the relay $R_4$ is operated by $R_2$, $R_7$ by $R_9$, $R_9$ by $R_4$ and $R_7$, $R_9$ and $R_{11}$ by $R_2$ and $R_4$ respectively. On the other hand, the relays of solenoid valves $SV_2$ and $SV_4$ are switched off to close solenoid valves $SV_2$ and $SV_4$, whereby electro-magnets $MG_2$ and $MG_4$ are pressed against the wall W by means of the restoring spring 46. Besides, after the lapse of a specified period in the above condition, the relay $R_7$, is switched off by operation of timer $T_1$ to switch off $R_9$ and $R_{11}$ successively so that the solenoid valves $SV_2$ and $SV_4$ are opened and pneumatic cylinders 72 and 74 are supplied with air. Moreover, after the lapse of a specified period, a timer $T_2$ starts working to operate to close relays $R_8$ and $R_9$ so that the relays $R_{13}$ and $R_{15}$ are switched on successively, whereby electro-magnets $MG_1$ and $MG_3$ are demagnetized and electro-magnets $MG_2$ and $MG_4$ adhere to the wall W. In addition as the relay $R_8$ is switched on the right rotation transmitting clutch SCR of the magnetic clutch 82 is operated to rotate the driving chain 12 and endless chains 7 and 10 in the direction of the arrow *c* whereby the body 5 moves in the right hand direction. In this case, electro-magnets $MG_1$ and $MG_3$ are separated from the wall W at a constant spaced distance (that is, in this embodiment at the distance $s/2$), resisting the pressure of the restoring spring 46 because the pneumatic cylinders 71 and 73 are supplied with air due to the demagnetization of electro-magnets $MG_1$ and $MG_3$.

Secondly, as the body 5 moves in the right hand direction, the limit switch $LS_2$ is switched on by the switching member 16 and the relay $R_1$ is operated thereby so that the relays $R_2$ and $R_4$ are switched off as $R_2$ returns to its original position and the relays $R_3$, $R_7$, $R_{10}$, and $R_{12}$ are successively operated, whereby solenoid valves $SV_1$ and $SV_3$ are closed. Therefore, the air in the pneumatic cylinders 71 and 73 is exhausted and the relays $R_{13}$ and $R_{15}$ are switched off, and then electro-magnets $MG_1$ and $MG_3$ are pressed against the wall W by means of the restoring spring 46 and excited to adhere to the wall.

Figure 4:
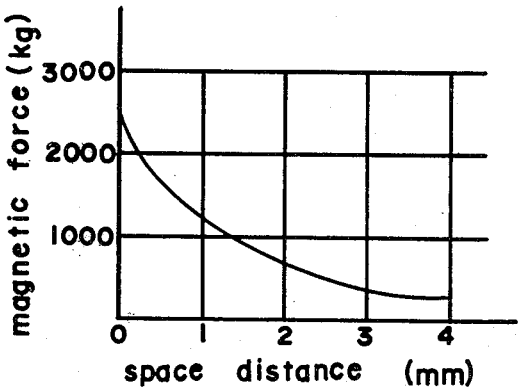
FIG. 4 is a curve showing the relationship of the magnetic force and the space or distance between the magnet and an object to which it is attracted.

On the other hand, when the relay $R_3$ is operated, the timer $T_1$ starts working to switch off the relay $R_8$ as $R_3$ returns to its original position so that all the electro-magnets $MG_1$, $MG_2$, $MG_3$, and $MG_4$ are excited while relays $R_{13}$, $R_{14}$, $R_{15}$ and $R_{16}$ are switched off and the conduction between the motor 81 and the transmission clutch of the right rotation SCR is intercepted since relay $R_8$ is switched off. After the lapse of a specified period the time $T_1$ is operated to switch off the relays $R_7$, $R_{10}$, and $R_{12}$ successively, so that the solenoid valves $SV_1$ and $SV_3$ are opened and the pneumatic cylinders 71 and 73 are supplied with air, and then electro-magnets $MG_1$ and $MG_3$ are excited to press the supporting rollers 79 and 80 of the body 5 agains the wall W. In this case, it is useful for preventing the present apparatus from slipping down caused by its weight to make the support connection for supporting roller 79 universally movable and to make the supporting roller 80 secured pivotally or to constitute both supporting rollers 79 and 80 from the materials which are of relatively high frictional resistance such as synthetic rubber and the like. Moreover, it is useful for preventing one pair of adhering members which do not adhere to the wall from being unable to keep a constant spaced distance from the wall because of the moment caused by its weight to arrange the supporting rollers 79 and 80 around the body 5 in a sufficient span. That is, the unbalance of the spaced distance between the adhering members and the wall causes the unbalance of the magnetic force of adhering members as shown in FIG. 4.

Furthermore, after the lapse of a specified period, the timer $T_2$ is operated and the relays $R_8$, $R_{14}$, and $R_{16}$ are respectively operated to demagnetize electro-magnets $MG_2$ and $MG_4$ and at the same time the magnetic clutch 82 is switched to the left rotation transmitting clutch SCL, whereby the driving chain 12 and the endless chains 7 and 10 are respectively rotated in the direction of the arrow *d* (FIG. 13) and then the body 5 moves further in the right hand direction. Then the limit switch $LS_1$ is again switched on by the switching member 16, whereby the abovementioned operations are repeated and the body 5 continuously moves in the right hand direction.

Figure 15:
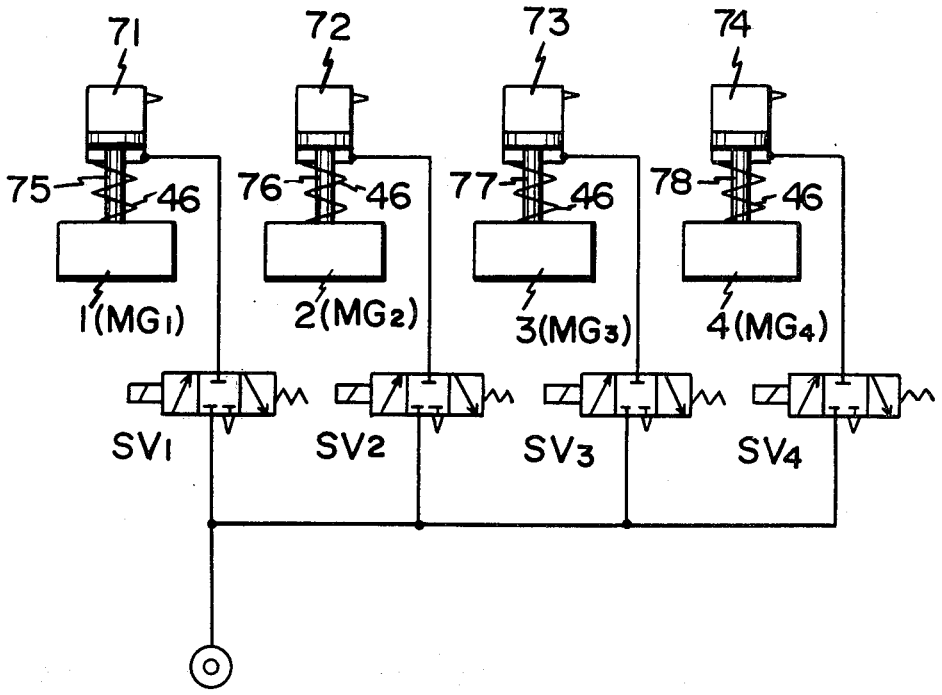
FIG. 15 is a schematic circuit diagram showing the pneumatic control of the fourth embodiment.
Figure 16:
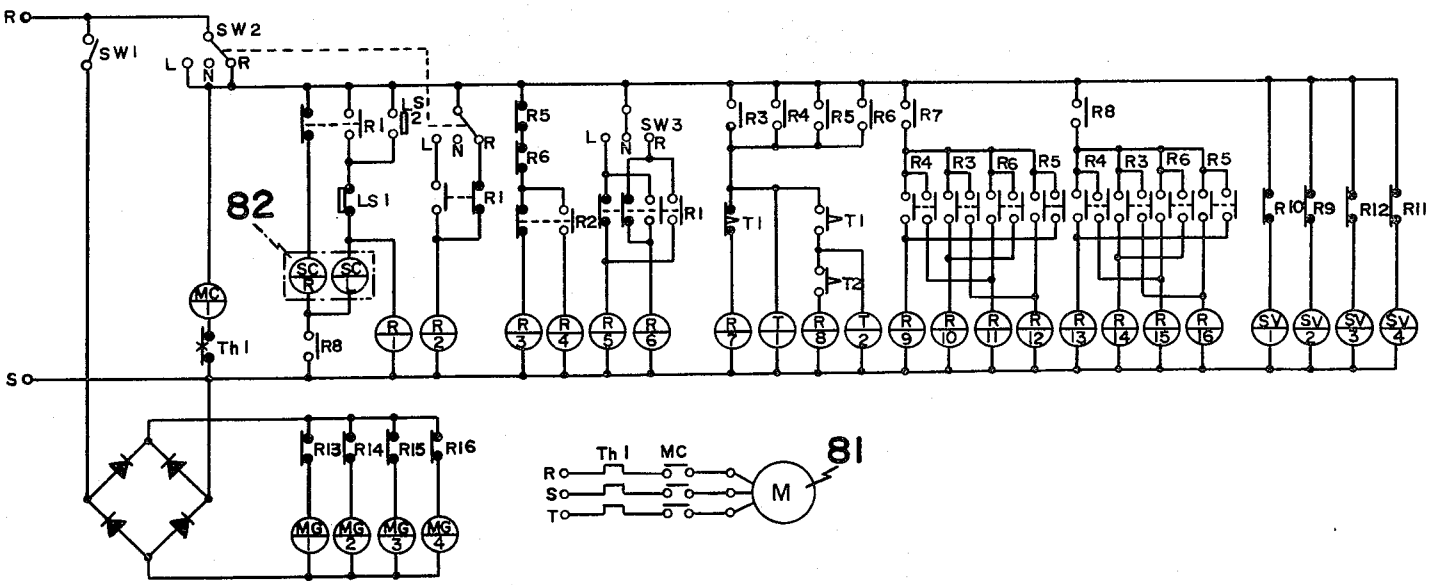
FIG. 16 is a schematic circuit diagram showing the electric control of the fourth embodiment.
Figure 18:
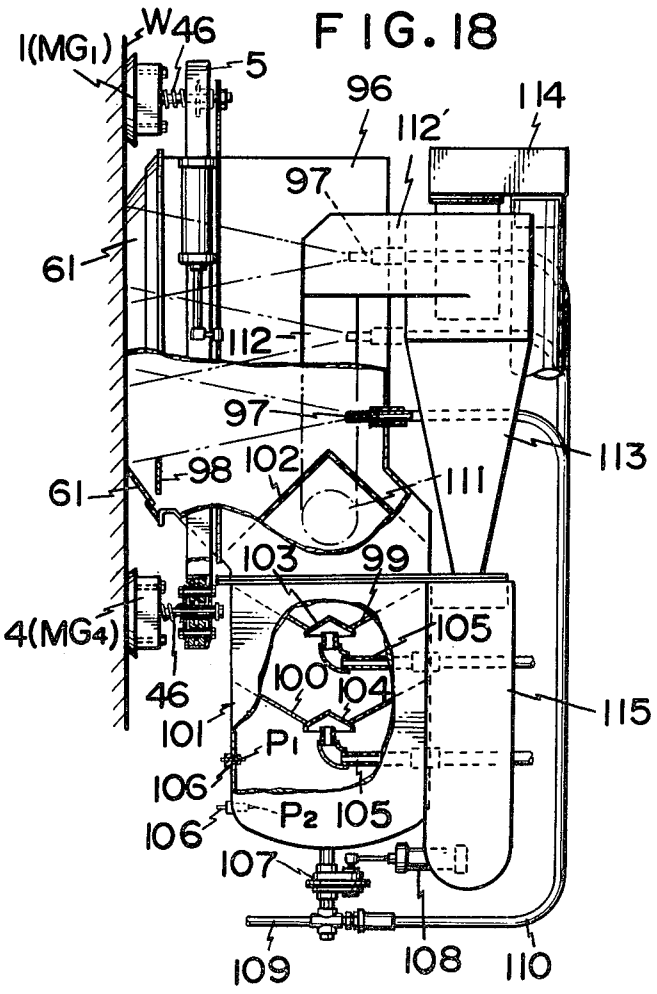
FIG. 18 is a sectional side elevation, partly broken away, of the fifth embodiment.
Figure 17:
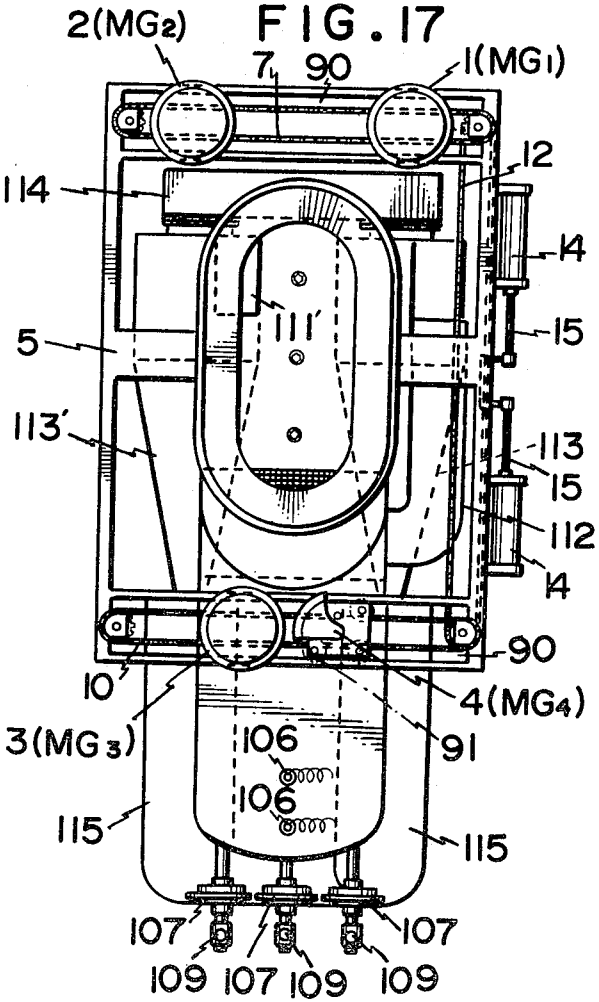
FIG. 17 is a front elevation view, partly broken away, showing a fifth embodiment of the present invention.
Figure 19:
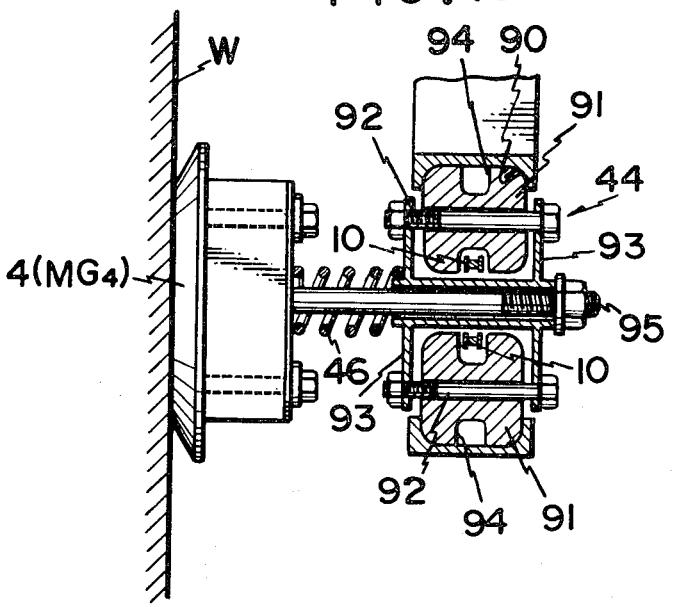
FIG. 19 is a partial enlarged sectional and side elevation view of the movable adhering apparatus of the fifth embodiment.
Figure 20:
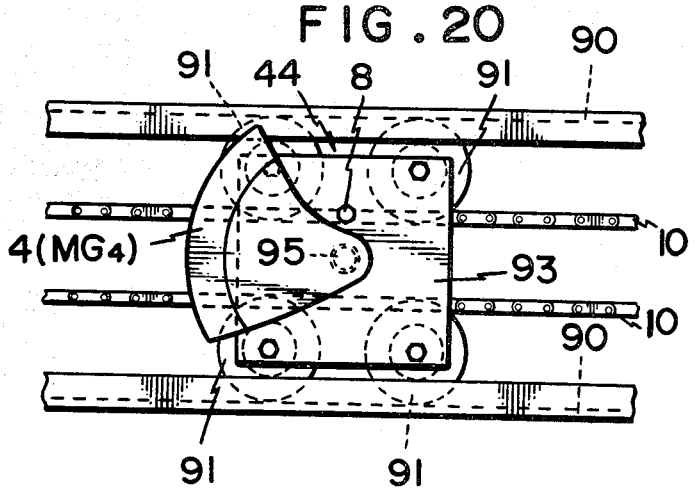
FIG. 20 is an enlarged elevation, partly in section, of the same movable adhering apparatus shown in FIG. 19.

Further, in case of moving the body 5 in the left hand direction or changing the moving direction of the body as shown in FIGS. 15 and 16, the body 5 can be operated according to the first embodiment.

THE FIFTH EMBODIMENT (FIGS. 17 – 22)

In this fifth embodiment, the moving apparatus is provided with a cleaning apparatus for blasting abrasive such as grit or the like to clean the surface of the wall, and the above blasting, cleaning apparatus comprises a device for blasting abrasive along with a device for collecting abrasive after blasting and a device for supplying collected abrasive to the blasting device.

The apparatus according to this fifth embodiment will be described with reference to FIGS. 17 – 20 as follows.

Figure 21:
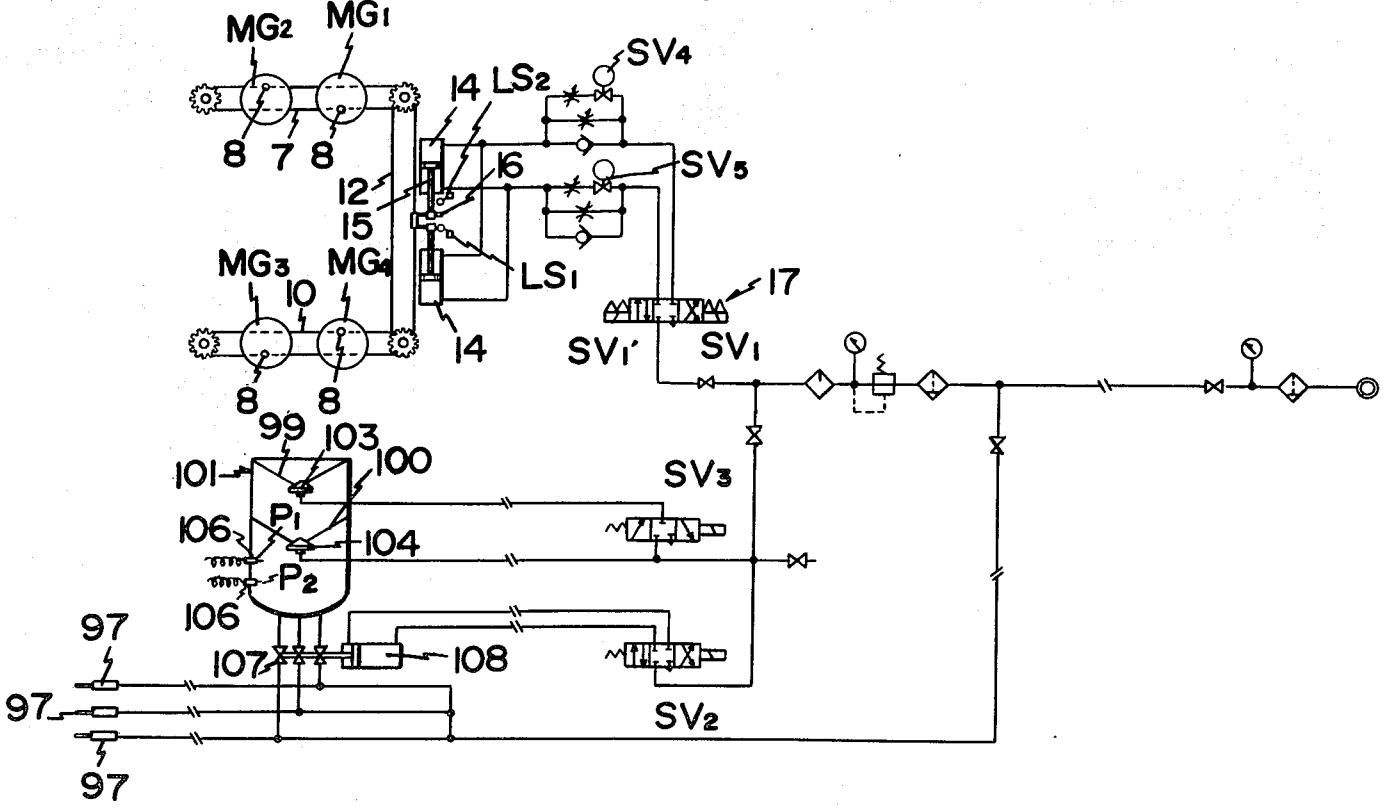
FIG. 21 is a schematic circuit diagram showing the pneumatic control of the fifth embodiment.

The frame body 5 is provided with sliding grooves 90 on its upper and lower part, and two pairs of sliding bases 41, 42, and 43, 44 are movable along the above sliding grooves 90 and are respectively affixed to endless chains 7 and 10 so as to move in the opposite direction relative to each other with respect to the sliding groove 90. The respective sliding bases 41, 42, 43, 44 include four rollers 91 fitting into the sliding grooves 90 and a supporting plate 93 supporting the above rollers 90 with a shaft 92 so as to provide for free rotation of the rollers 91. All of the rollers 91 include grooves 94 through which endless chains 7 and 10 can pass. Moreover, electro-magnets $MG_1$, $MG_2$, $MG_3$, and $MG_4$ respectively corresponding to the adhering members 1, 2, 3, and 4 are affixed to the end of a shaft 95 mounted on the supporting plate 93 by means of a restoring spring 46. Each end of the two piston rods 15 (FIG. 21) of the pneumatic cylinders 14 which interlocking move upwardly and downwardly are connected to the driving chain 12 which drives endless chains 7 and 10 interlockingly. The movement of the piston rod 15 is operated by the change of the four-ported solenoid operated valve 17 as shown in FIG. 21. Furthermore, a switching member 16 is provided at the end of the piston rod 15 in order to operate the limit switches $LS_1$ and $LS_2$ interchangeably.

Adjoining the body 5 there is installed a blasting chamber 96 which has openings at its front part opening against the steel wall W and having a lower section and a section around the front opening forming a flexible sealing member 61 made of rubber and which is set up so as to adhere closely to the wall W to be able to collect the abrasive which is blasted from a nozzle in the blasting chamber without being scattered to the outside. Reference numeral 98 indicates a protective plate for preventing the sealing member 61 from being worn away by the blasted abrasive.

At the lower opening of the blasting chamber 96, a pressure tank 101 comprising an upper hopper 99 and a lower hopper 100 is provided whereby the abrasive which was blasted against the wall W from the nozzle 97 is collected in the upper hopper 99 of the pressure tank 101. The reference numeral 102 indicates a screen for preventing the entry of foreign substances into the pressure tank 101, 103 indicates a closing valve for the upper hopper 99, 104 indicates a closing valve for the lower hopper 100, 105 indicates a feed air pipe for the tank, 106 indicates and electrode plug, 107 indicates a regulator valve for the abrasive flow, 108 indicates a pneumatic cylinder for opening and closing a regulator valve 107, 109 indicates a feed pipe for the compressed air which propels the abrasive out of the nozzle 97, and 110 indicates a blasting hose communicating with the nozzle 97.

Figure 22:
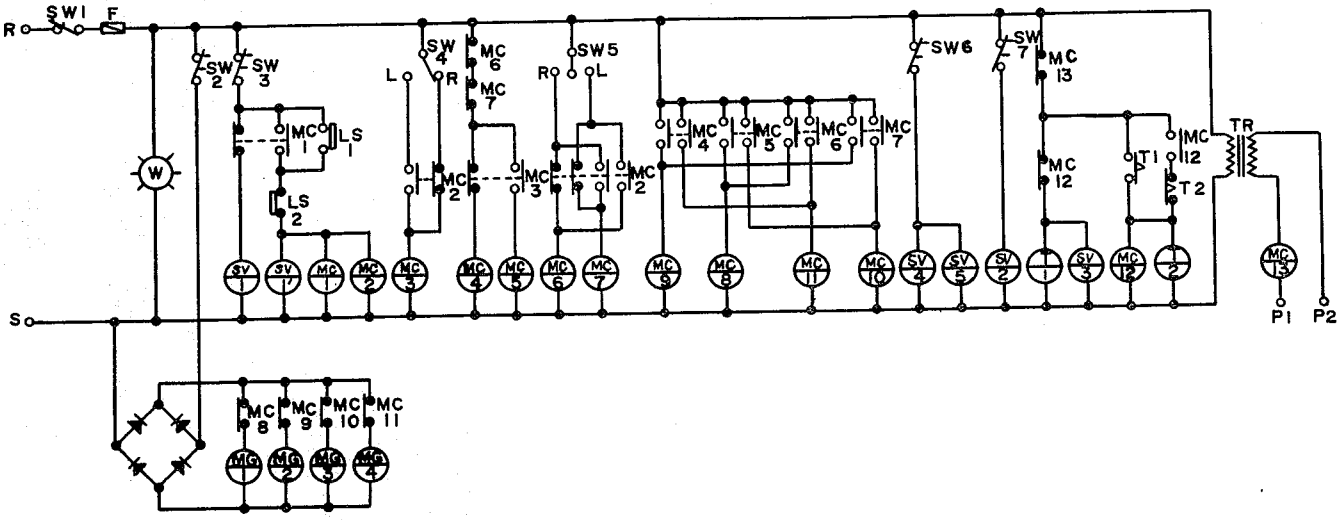
FIG. 22 is a schematic circuit diagram showing the electric control of the fifth embodiment.

The description regarding the operation of the moving apparatus according to the fifth embodiment can be made referring to FIG. 21 which shows the pneumatic controlling circuit diagram and to FIG. 22 which shows the electric controlling circuit diagram. However, it is apparent that the present movable apparatus can be operated in the same manner as the aforementioned embodiments, so that the common operational features are omitted. There is provided a switch $SW_3$ which is an on-off switch, $SW_4$ which is a switch for controlling the movement in the right and left hand direction, and $SW_5$ which is a switch for changing the moving direction all as shown in FIG. 22. Further, solenoid valves $SV_4$ and $SV_5$ as shown in FIG. 21 are opened by switching on a switch $SW_6$ (FIG. 22) to increase the flow of compressed air, whereby the moving speed can be accelerated.

On the basis of FIGS. 21 and 22, the mechanism for blasting and collecting the abrasive will be described as follows.

At first, in this fifth embodiment, assuming that a good conductor such as steel grit or steel chip is employed as the abrasive, the electrode plug 106 is used as a level detector. But it is also possible to employ insulating material such as sand or the like as the abrasive if a motor level detector is used.

In case that there is a little quantity of abrasive in the lower part of the pressure tank 101 and the electrode plug 106 is insulated or open between the contacts $P_1$ and $P_2$, the solenoid valve $SV_3$ is switched on and the compressed air in the upper tank of the pressure tank 101 is discharged to the outside, so that the closing valve 103 of the upper hopper 99 falls by gravity due to the atmospheric pressure in the upper tank, whereby the abrasive piled up in the upper hopper 99 falls down into the lower part of the tank. At the same time that $SV_3$ is switched on, a timer $T_1$ which was previously set to the period when the abrasive began to fall down from the upper hopper 99 and which is set to correspond to the volume of the upper part of the tank is also switched on, so that if the abrasive had filled up the upper part of the tank, the delay contact $T_1$ of the timer is operated to switch on $MC_{12}$, whereby $SV_3$ and $T_1$ are switched off. Therefore, the compressed air is again introduced into the upper part of the tank and the closing valve 103 of the upper hopper 99 is pushed upwardly and since the pressure in the upper part of the tank and the pressure in the lower part of the tank become the same, the closing valve 104 of the lower hopper 100 is opened by gravity and the abrasive in the upper part of the tank falls down into the lower part of the tank.

Furthermore, when the abrasive falls down into the lower part of the tank and makes a continuity or connection between the contacts $P_1$ and $P_2$ of the electrode plug 106, $MC_{13}$ is switched on instead of $MC_{12}$ since MC13 returns to its original position. In case the quantity of abrasive that falls down from the upper part of the tank into the lower part of the tank is not large and $P_1$ and $P_2$ are not closed, timer $T_1$ is activated by $MC_3$ and $MC_2$ and accordingly $MC_{12}$ is actived. Since the timer $T_2$ is switched on at the same time as $MC_{12}$ is switched on, after the lapse of the same settled delay time as the timer $T_1$, the delay contact $T_2$ is operated to switch off $MC_{12}$ so that $MC_{12}$ returns to its original position and $SV_3$ and $T_1$ are again switched on and the abrasive resumes flowing into the lower part of the tank from the upper hopper 99. Even if the abrasive is small in quantity in the lower part of the tank and $P_1$ and $P_2$ are not closed, $SV_3$and $T_1$ are again switched on and the abrasive resumes flowing into the lower part of the tank from the upper hopper 99. As mentioned above, the abrasive in the lower part of the tank is continually under a pressured condition, so that the abrasive is continuously blasted from the nozzle 97. Further, in this fifth embodiment, the pressure tank is of the compartment type. However, in cases employing a one compartment type, the abrasive is intermittently blasted from the nozzle 97.

In FIG. 22, $SW_7$ is a switch for switching on and off the solenoid valves $SV_2$ to control the movement of the piston rod of the pneumatic cylinder 108 to open or close the regulator valve 107 for controlling the abrasive flow. Moreover, in FIGS. 17 and 18, the reference numerals 111 and 111' indicate suction ports which respectively open in the lower and rear part of the blasting chamber 96 and exhaust the air in the blasting chamber, and they are respectively connected to other suction ports of two cyclones 113 and 113' by the duct 112 and 112'. The reference number 114 indicates a duct connected to the above suction ports of the cyclones and the flexible duct or hose (as shown in FIG. 3), and this flexible duct or hose is further connected to the dust collector. The reference numeral 115 indicates a dust bag in which the dust collected by the above cyclone is gathered.

As mentioned above, the movable apparatus according to the present invention can move along the wall in a desired direction while adhering thereto completely and continually, so that even if this movable apparatus includes a considerably heavy working device such as a cleaning device, there is little fear of falling down and this apparatus can accomplish the safe and secure movement adhering to the wall regardless of the surface condition of the wall. Therefore, the cleaning operation of the wall can be performed efficiently with safety and security in a remote-controlled operation by providing the present apparatus movably adhering to the wall with the cleaning device of grit blasting or other working devices.

It is thought that the invention and many of its attendant advantages will be understood from the foregoing description and that it will be apparent that various changes may be made in the form, construction, and arrangements of the parts without departing from the spirit and scope of the invention or sacrificing all of its material advantages. The form heretofore described being merely a preferred embodiment thereof.

What is claimed is:

1. An apparatus movably adhering to a wall comprising a body adapted to move along said wall, two pairs of adhering devices selectively operable to adhere to said wall, operable means operably mounting said two pairs of adhering devices on said body such that said adhering devices are movable in parallel directions with the two adhering devices in each pair being movable in opposite directions relative to one another, drive means for interlockingly driving said operable means in said parallel and opposite movable directions, and means for selectively switching said adhering devices on and off such that said adhering devices are operable to adheringly move said body along said wall.

2. An apparatus accroding to claim 1 in which said adhering devices are electro-magnets.

3. An apparatus according to claim 1 in which said adhering devices are vacuum adhering members.

4. An apparatus according to claim 1 in which said operable means for mounting said adhering devices on said body comprises a pair of endless chains mounted on said body and each having parallel runs, and means attaching said adhering devices to said parallel runs of said chains such that when one adhering device on one run of said chain moves in one direction, the other adhering device on the other run of said chain moves in an opposite direction.

5. An apparatus according to claim said body, wherein said operable means comprises parallel guides mounted on saidbody, said adhering devices being slidably mounted on said guides by said endless chains.

6. An apparatus according to claim 5 wherein said operable means comprises means pivotally supporting a central portion of said guides on said body, links pivotally connected to the end portions of said guides, and power means mounted on said body and operably connected to one of said guides to thereby effect parallel and simultaneous pivotal movement of both of said guides, whereby said power means is operable to selectively vary the angle of said guides relative to said body and thereby control the direction of movement of said body on said wall.

7. An apparatus according to claim 1 wherein said operable means comprises parallel guides mounted on said body, slidable bases slidably mounted on said guides, first means mounting said adhering devices on said slidable bases, whereby said adhering devices are universally movable relative to said slidable bases, and biasing means biasing said adhering devices in a fixed position relative to said slidable bases.

8. An apparatus according to claim 7 wherein said first mounting means comprises cylinder means each having a cylinder and a piston rod interposed between said adhering devices and said slidable bases on which said adhering devices are mounted, and rollers mounted on said piston rods and adapted to engage said wall.

9. An apparatus according to claim 1 wherein said operable means comprises parallel guides mounted on said body, slidable bases mounted on said guides, second means mounting said adhering devices on said slidable bases, said second means comprising cylinders fixed to said slidable bases, piston rods extending from said cylinders and passing through said slidable bases, and universal means providing a universal connection between said adhering devices and the ends of said piston rods.

10. An apparatus according to claim 9 wherein said piston rods have operating strokes of which the midpoint thereof is arranged to serve as the supporting point of said body against said wall.

11. An apparatus according to claim 10 including universally movable support rollers and pivotally movable support rollers mounted in suitably spaced relationship on said body and adapted to engage said wall.

12. An apparatus according to claim 1 wherein said operable means comprises parallel guides mounted on said body, movable bases mounted on said guides, said bases including rollers rollable in said guides, means rotatably mounting said rollers and having a rod projecting therefrom, said adhering devices being mounted on the end portions of said rods.

13. An apparatus according to claim 12 wherein said rollers have grooves in their peripheral surface, and chains for driving said movable bases disposed in said grooves.

14. An apparatus according to claim 2 including first sprockets mounted on said body and on which said endless chains are carried, said drive means comprising second sprockets fixed to at least one of said first sprockets, endless chain means carried on said second sprockets, and a power cylinder means mounted on said body and operatively connected to said second chain means to thereby drive the latter.

15. An apparatus according to claim 1 wherein said operable means comprises parallel guides mounted on said body, slidable bases slidably mounted on said guides, first means mounting said adhering devices on said slidable bases, and power cylinder means having a cylinder and a piston operatively connected between two of said sliding bases on the same sliding guide to thereby move said two sliding bases in opposite directions.

16. An apparatus according to claim 2 including first sprockets mounted on said body and on which said endless chains are carried, said drive means comprising second sprockets fixed to at least one of said first sprockets, endless chain means carried on said second sprockets, and a driving motor operable with a speed reduction device for driving said chain means.

17. An apparatus according to claim 16 including a magnetic clutch means operatively connected to said driving motor and operable to function as a right rotation transmitting clutch or a left rotation transmitting clutch.

18. An apparatus according to claim 1 including limit switches mounted on said body, and switching means mounted on said operable means and movable in correspondence with the movement of said adhering devices, said switching means being operable to engage said limit switches upon movement of the body along said wall and thereby control the selective operation of said adhering devices and said operable mounting means.

* * * * *